United States Patent [19]

Tanca

[11] 4,343,627

[45] Aug. 10, 1982

[54] METHOD OF OPERATING A TWO-STAGE COAL GASIFIER

[75] Inventor: Michael C. Tanca, Tariffville, Conn.

[73] Assignee: Combustion Engineering, Inc., Windsor, Conn.

[21] Appl. No.: 210,899

[22] Filed: Nov. 28, 1980

[51] Int. Cl.[3] ..... C10J 3/46

[52] U.S. Cl. ..... 48/202; 48/210; 48/DIG. 4

[58] Field of Search ..... 48/202, 210, 206, 86 R, 48/DIG. 4

[56] References Cited

U.S. PATENT DOCUMENTS

| | | | |
|---|---|---|---|
| 3,454,383 | 7/1969 | Pirsh et al. | 48/203 |
| 3,689,240 | 9/1972 | Aldridge et al. | 48/202 |
| 3,864,100 | 2/1975 | Blaskowski | 48/202 |
| 4,017,269 | 4/1977 | Dutz et al. | 48/86 R |
| 4,158,552 | 6/1979 | Baskowski et al. | 48/210 |
| 4,168,956 | 9/1979 | Blaskowski | 48/210 |

*Primary Examiner*—S. Leon Bashore, Jr.
*Assistant Examiner*—Michael Goldman
*Attorney, Agent, or Firm*—William W. Habelt

[57] ABSTRACT

A method of operating an entrained flow coal gasifier (10) via a two-stage gasification process. A portion of the coal (18) to be gasified is combusted in a combustion zone (30) with near stoichiometric air to generate combustion products. The combustion products are conveyed from the combustion zone into a reduction zone (32) wherein additional coal is injected into the combustion products to react with the combustion products to form a combustible gas. The additional coal is injected into the reduction zone as a mixture (60) consisting of coal and steam, preferably with a coal-to-steam weight ratio of approximately ten to one.

2 Claims, 1 Drawing Figure

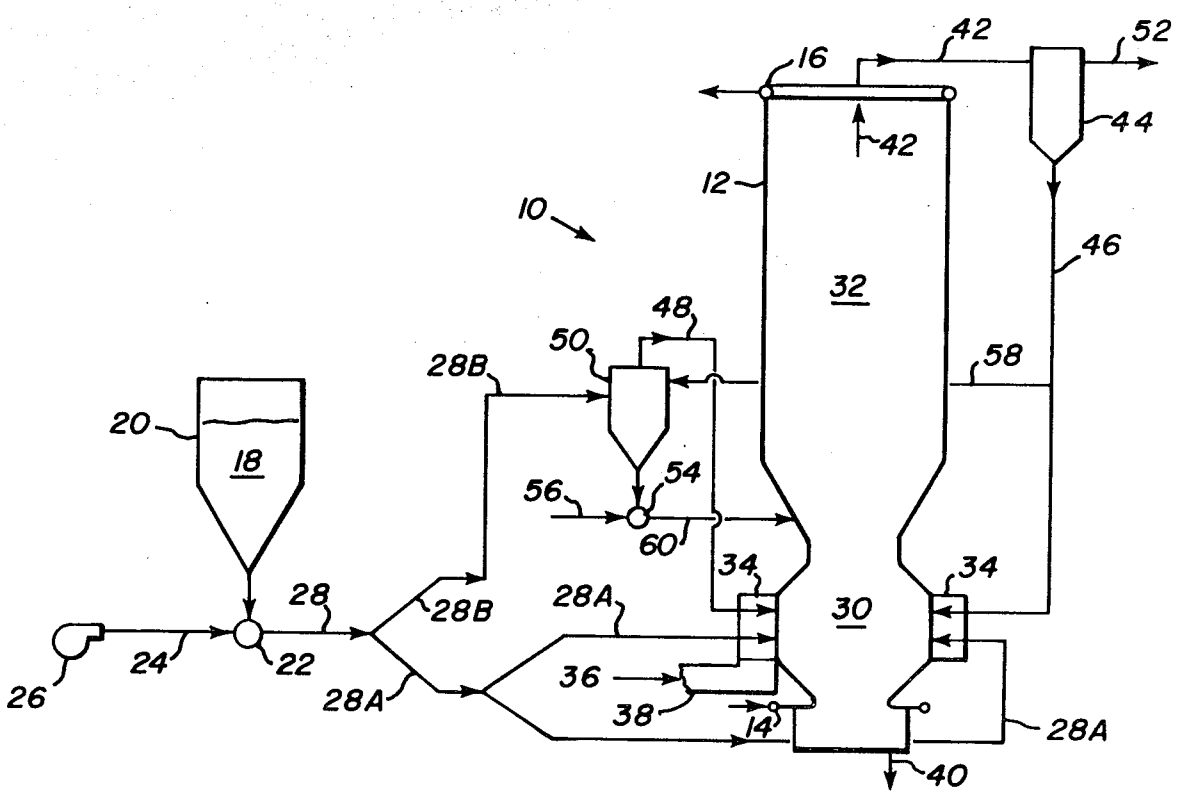
10
12
14
16
18
20
22
24
26
28
28A
28B
30
32
34
36
38
40
42
44
46
48
50
52
54
56
58
60

METHOD OF OPERATING A TWO-STAGE COAL GASIFIER

BACKGROUND OF THE INVENTION

This invention relates to entrained flow gasifiers and, more specifically, to a method of operating such gasifiers.

A two-stage entrained flow gasifier is essentially comprised of a combustion zone and a reduction zone. In the combustion zone, coal is burned to generate hot combustion products which supply the heat required for the gasification process which takes place in the reduction zone. The combustion zone is operated at near stoichiometric conditions to obtain the maximum heat and also to melt the ash so that it may be removed in the form of slag. As applied to combustion and gasification, stoichiometric refers to the theoretical amount of oxygen or air required to completely burn the material being combusted. Off-stoichiometric refers to any ratio greater or less than the theoretical ratio while substoichiometric refers to a lesser amount of oxygen or air theoretically required for complete combustion. The operation of the combustion zone is off-stoichiometric only to the extent required to reduce the temperature within the combustion zone to a point which the materials forming the combustion zone can tolerate.

The combustion products formed in the combustion zone are conveyed into a reduction zone where they are mixed with additional pulverized coal. The additional coal is devolatized and the remaining carbon residue, termed char, reacts with the combustion products in the reduction zone to form a combustible gas which is largely carbon monoxide. The gasification reaction is an endothermic reaction obtaining its heat from the combustion products formed in the combustion zone. The gasification process continues within the reduction zone until the temperature is reduced to a level at which the gasification reaction rate is too slow for practical purposes. Any remaining coal particles in the form of char are removed from the combustible gas leaving the reduction zone and recycled either to the combustion zone or the reduction zone.

If the proper gasification reactions are to occur, it is imperative that a reducing atmosphere be maintained in the reduction zone. In most prior art entrained flow gasifiers, the additional coal injected into the reduction zone is typically conveyed from a pulverized coal bin to the reduction zone in a stream of air. Unfortunately, when the air enters the reduction zone, it preferentially reacts with the carbon monoxide generated in the gasification process rather than reacting with the additional coal injected into the reduction zone. This results in a poor gasification process and a lower heating value for the combustible product gas produced in the reduction zone. The use of air to convey the coal being injected into the reduction zone also limits the maximum heating value obtainable with an entrained flow gasifier.

One solution to this problem is presented in U.S. Pat. No. 3,454,383. As disclosed therein, the coal being injected into the reduction zone is conveyed from the coal source to the reduction zone in a stream of hot product gas taken from a point downstream of the reductor zone. Because the product gas itself is now the medium in which the coal is conveyed to the reduction zone, there is no decrease in heating value of the product gas due to oxygen in the conveying medium reacting with the carbon monoxide in the product gas. However, a major problem associated with this scheme is that the hot product gas is a combustible which could conceivably explode if allowed to reach its ignition temperature during the process of conveying coal to the reduction zone.

Another scheme for solving the above-mentioned problem is presented in U.S. Pat. No. 4,017,269. As disclosed therein, an inert gas is used as the medium to carry coal from the coal source to the reduction zone. Because the conveying medium is inert gas, there is no reaction with the product gas generated within the reduction zone as there would be if air were used as the conveying medium. Further, the hazard of an explosion which would exist if production gas is used as the conveying medium is avoided by using inert gas as the conveying medium. Nevertheless, the heating value of the product gas generated within the reduction zone is lowered because the inert gas tends to dilute the product gas. That is, the inert gas tends to absorb heat which would otherwise be part of the heating value of the product gas formed in the reduction zone, as well as adding unnecessary inert volume to the product gas.

SUMMARY OF THE INVENTION

It is an object of the invention to increase the effectiveness of an entrained flow gasifier by enhancing its ability to produce a product gas having an increased heating value.

In accordance with the present invention, steam is used as the conveying medium for carrying the additional coal to be injected into the reduction zone from the coal source to the reduction zone. Upon entering the reduction zone, the steam will react with the additional coal to form carbon monoxide and hydrogen. Therefore, rather than lowering the heating value of the product gas as is the case when either air or inert gas are used as the conveying medium, the steam will react to form additional carbon monoxide and hydrogen thereby increasing the heating value of the product gas formed in the reduction zone. Further, by using steam as the conveying medium, the possibility of an explosion in the transport line between the coal source and the reduction zone is eliminated.

BRIEF DESCRIPTION OF THE DRAWING

The FIGURE is a schematic illustration of a gasifier according to the present invention.

DESCRIPTION OF THE PREFERRED EMBODIMENT

Referring now to the drawing, there is depicted therein a gasifier generally indicated as 10 formed of bounding walls 12 of steam generating tubes. Water is supplied to the lower header 14, passes upwardly through the bounding walls 12 wherein steam is generated. The steam and water mixture leaving the bounding walls 12 is collected in the upper header 16 and passed therefrom to perform useful work.

To fire the gasifier, pulverized coal 18 is fed from the pulverized coal storage bin 20 through feeder 22 and injected into a stream of combustion air 24 supplied by forced draft fan 26 to form a conventional dilute phase coal-air stream 28 for transporting the coal to the gasifier. Although air is most frequently used as the combustion oxidizer, oxygen-rich air or pure oxygen may be used. It is customary also to preheat the air or other combustion oxidizer.

The dilute phase stream of pulverized coal and air 28 leaving the feeder 22 is split into a first stream 28A and a second stream 28B. The first stream 28A is conveyed to the combustion zone 30 of the coal gasifier 10 while the second stream 28B is conveyed to the reduction zone 32 of the gasifier 10. The dilute phase coal and air stream 28A is injected into the combustion zone 30 through windbox 34 surrounding the combustor. Additional combustion air 36 is supplied to the combustion zone 30 through duct 38 which opens into windbox 34.

The ratio of coal to air in the combustion zone 30 is maintained as near stoichiometric as possible considering the ability of the structural materials to withstand the temperature. Ash melts in the combustor and is removed through slag spout 40. The combustion products formed during the combustion process in the combustion zone 30 pass upwardly into the reduction zone 32. In this zone additional coal is injected into the combustion products. This coal is devolatized and gasified while undergoing an endothermic reaction with the combustion products to form a combustible product gas 42. The combustible product gas formed within the reduction zone 32 of the gasifier 10 is then passed through a dust collector 44 wherein any unreacted coal in the form of char is removed from the product gas to yield a clean, combustible product gas 52. The char particles collected in the dust collector 44 are returned through line 46 to the gasifier 10 and introduced into the combustion zone 30 to be combusted therein. Alternatively, the char collected in the dust collector 44 may be directly recycled into the gasification process by being introduced into the reduction zone 32 rather than into the combustion zone 30.

In accordance with the present invention, the second dilute phase coal and air stream 28B which is being conveyed to the reduction zone 32 of the coal gasifier 10 is first passed through a cyclone separator 50 wherein the pulverized coal is separated from the air portion of stream 28B. The air portion of the stream 28B is vented from the cyclone separator 50 through line 48 and injected into the combustion zone 30 of the coal gasifier 10 wherein any coal remaining therein is combusted. The pulverized coal removed from the coal and air stream 28B in the cyclone separator 50 is fed from the cyclone separator 50 and injected through feeder 54 into a stream of steam 56 to form a coal and steam mixture 60 which is then conveyed to the reduction zone 32 of the gasifier 10. In the preferred embodiment of the present invention, the coal and steam mixture is a dense phase mixture consisting of coal and steam in a coal-to-steam weight ratio of approximately ten to one.

If the char removed from the product gas 42 in the dust collector 44 is to be recycled into the reduction zone 32 of the coal gasifier 10, the char is directed from the dust collector 44 through line 58 to the cyclone separator 50 wherein it mixes with the pulverized coal removed from the coal and air stream 28 as it passes through the cyclone separator 50. Thereafter, the char is introduced along with the pulverized coal into the steam stream to form the coal and steam mixture 60 which is conveyed to the reduction zone 32 of the coal gasifier 10. Thus, it is within the scope of the present invention that a portion of the coal being injected into the reduction zone of the gasifier in the coal and steam mixture is in the form of char.

Upon entering the reduction zone 32 of the gasifier 10, the coal within the coal and steam mixture reacts with the hot combustion products formed in the combustion zone 30 to form the combustible product gas 42. In addition, a portion of the coal in the coal and steam mixture reacts at the temperatures within the reduction zone 32 with the steam being used as the conveying medium to form hydrogen and carbon monoxide. Thus, rather then having the conveying medium dilute the product gas as is the case when an inert gas is used or reacting with the product gas as is the case when air is used as the conveying medium, the steam reacts with the coal itself to form combustible hydrogen and carbon monoxide. Accordingly, the heating value of the product gas 42 formed within the reaction zone 32 of the gasifier 10 is not lowered by the presence of the conveying medium. Rather, the steam being used as the conveying medium has the synergistic effect of enhancing the production and the quality of the product gas.

While only one embodiment of the invention has been illustrated, it would be appreciated that modifications thereof may readily be made thereto by those skilled in the art. Therefore, it is intended by the appended claims to cover any modifications which fall within the true scope and spirit of the invention.

I claim:

1. In a method of operating of an entrained flow coal gasifier, of the type wherein coal is burned in a combustion zone with near stoichiometric air to generate combustion products, the combustion products are conveyed from the combustion zone into a reduction zone, and additional coal is injected into the combustion products in the reduction zone to react with the combustion products therein to form a combustible gas, the improvement in supplying coal to the gasifier comprising:

a. establishing a dilute phase mixture of pulverized coal and air;

b. splitting said dilute phase mixture of pulverized coal and air into a first and a second portion;

c. conveying the first portion of said dilute phase mixture of pulverized coal and air to the combustion zone of the gasifier;

d. separating the pulverized coal from the air of the second portion of said dilute phase mixture;

e. conveying the air of the second portion of said dilute phase mixture to the combustion zone of the gasifier;

f. mixing the pulverized coal separated from the air of the second portion of said dilute phase mixture with steam to establish a dense phase mixture thereof having coal-to-steam weight ratio of approximately ten to one; and g. conveying said dense phase mixture of pulverized coal and steam to the reduction zone of the gasifier.

2. A method as recited in claim 1 further comprising mixing char particles with the pulverized coal separated from the air of the second portion of the dilute phase mixture prior to mixing the pulverized coal with steam to establish said dense phase mixture.

* * * * *